US006817258B2

(12) United States Patent
Kajino et al.

(10) Patent No.: US 6,817,258 B2
(45) Date of Patent: Nov. 16, 2004

(54) STARTER FOR INTERNAL COMBUSTION ENGINE

(75) Inventors: Sadayoshi Kajino, Kariya (JP); Youichi Hasegawa, Kariya (JP); Yasuo Osawa, Tokyo (JP)

(73) Assignees: Denso Corporation, Kariya (JP); Sawafuji Electric Co., Ltd., Tokyo (JP)

( * ) Notice: Subject to any disclaimer, the term of this patent is extended or adjusted under 35 U.S.C. 154(b) by 27 days.

(21) Appl. No.: 09/996,781

(22) Filed: Nov. 30, 2001

(65) Prior Publication Data

US 2002/0066430 A1 Jun. 6, 2002

(30) Foreign Application Priority Data

Dec. 5, 2000 (JP) ..... 2000-370684

(51) Int. Cl.[7] ..... F02N 15/06

(52) U.S. Cl. ..... 74/7 A; 74/6; 74/7 R

(58) Field of Search ..... 74/6, 7 A, 7 R, 74/606 R

(56) References Cited

U.S. PATENT DOCUMENTS

| | | | | | |
|---|---|---|---|---|---|
| 4,184,378 | A | * | 1/1980 | Mazzorana | 74/7 A |
| 4,325,265 | A | * | 4/1982 | Wakatsuki et al. | 74/7 R |
| 5,167,162 | A | * | 12/1992 | Nagashima et al. | 74/7 A |
| 5,821,662 | A | * | 10/1998 | Kajino et al. | 74/7 R |
| 5,844,336 | A | * | 12/1998 | Ohya et al. | 74/6 |
| 5,847,471 | A | | 12/1998 | Morishita et al. | 290/48 |

* cited by examiner

*Primary Examiner*—David A. Bucci
*Assistant Examiner*—Bradley J. Van Pelt
(74) *Attorney, Agent, or Firm*—Oliff & Berridge, PLC

(57) ABSTRACT

A starter for an internal combustion engine includes a planetary gear speed reduction mechanism, a pinion and a pinion drive shaft, a motor, a front housing having a plurality of fastening holes disposed at a circumference and a center casing having approximately the same outside diameter as the motor housing. The center housing is disposed between the motor housing and the front housing to align a motor shaft, the planetary gear speed reduction mechanism and the pinion drive shaft. The diameter of the motor housing is a maximum outside diameter of the fastening bolt less than the diameter of a circumference on which the fastening bolts are formed. Therefore, fastening bolts can be easily inserted into the fastening holes.

8 Claims, 6 Drawing Sheets

STARTER FOR INTERNAL COMBUSTION ENGINE

CROSS REFERENCE TO RELATED APPLICATION

The present application is based on and claims priority from Japanese Patent Application 2000-370684 filed Dec. 5, 2000, the contents of which are incorporated herein by reference.

BACKGROUND OF THE INVENTION

1. Field of the Invention

The present invention relates to a starter for an internal combustion engine and particularly, a starter for a large-sized diesel engine.

2. Description of the Related Art

A starter for a large-sized diesel engine employs a starter motor, a pinion gear to be engaged with a ring gear of a diesel engine and a planetary gear speed reduction mechanism disposed between the starter motor and the pinion gear. The speed reduction mechanism is necessary to provide a compact starter motor. In such a starter, the motor shaft of the starter motor and a pinion drive shaft are not coaxially connected. Usually, the motor shaft is supported by a motor housing, and the pinion drive shaft is supported by a front housing that has a flange which is fixed to a portion of the engine by a fastening bolt. Since the motor shaft and the pinion drive shaft are not coaxially disposed, the motor housing overhangs the flange. Therefore, it is impossible to mount such a starter on the engine by a common socket wrench. It was necessary to use a special tool to mount on or demount from such a starter on the engine.

SUMMARY OF THE INVENTION

Therefore, a main object of the invention is to provide a compact starter for an internal combustion engine that can be mounted on an engine easily with a common tool such as a socket wrench.

According to a main feature of the invention, starter for an internal combustion engine includes a planetary gear speed reduction mechanism, a pinion to be engaged with a ring gear of the engine and a pinion drive shaft connected to the speed reduction mechanism, a motor having a motor housing, a front housing for supporting the pinion drive shaft at an end, a center casing for supporting the pinion drive shaft at the other end. The front housing has a flange to be fixed to a portion of the engine. The motor housing has a first outside diameter, and the flange has a plurality of fastening holes disposed at a circumference having a second diameter. The center housing is disposed between the motor housing and the front housing to align a motor shaft, the planetary gear speed reduction mechanism and the pinion drive shaft. A difference between the first outside diameter and the second diameter is larger than a maximum outside diameter of the fastening bolt so that the fastening bolt can be inserted into the fastening hole along the outer periphery of the motor housing.

BRIEF DESCRIPTION OF THE DRAWINGS

Other objects, features and characteristics of the present invention as well as the functions of related parts of the present invention will become clear from a study of the following detailed description, the appended claims and the drawings. In the drawings:

DETAILED DESCRIPTION OF THE PREFERRED EMBODIMENTS

Figure 1:
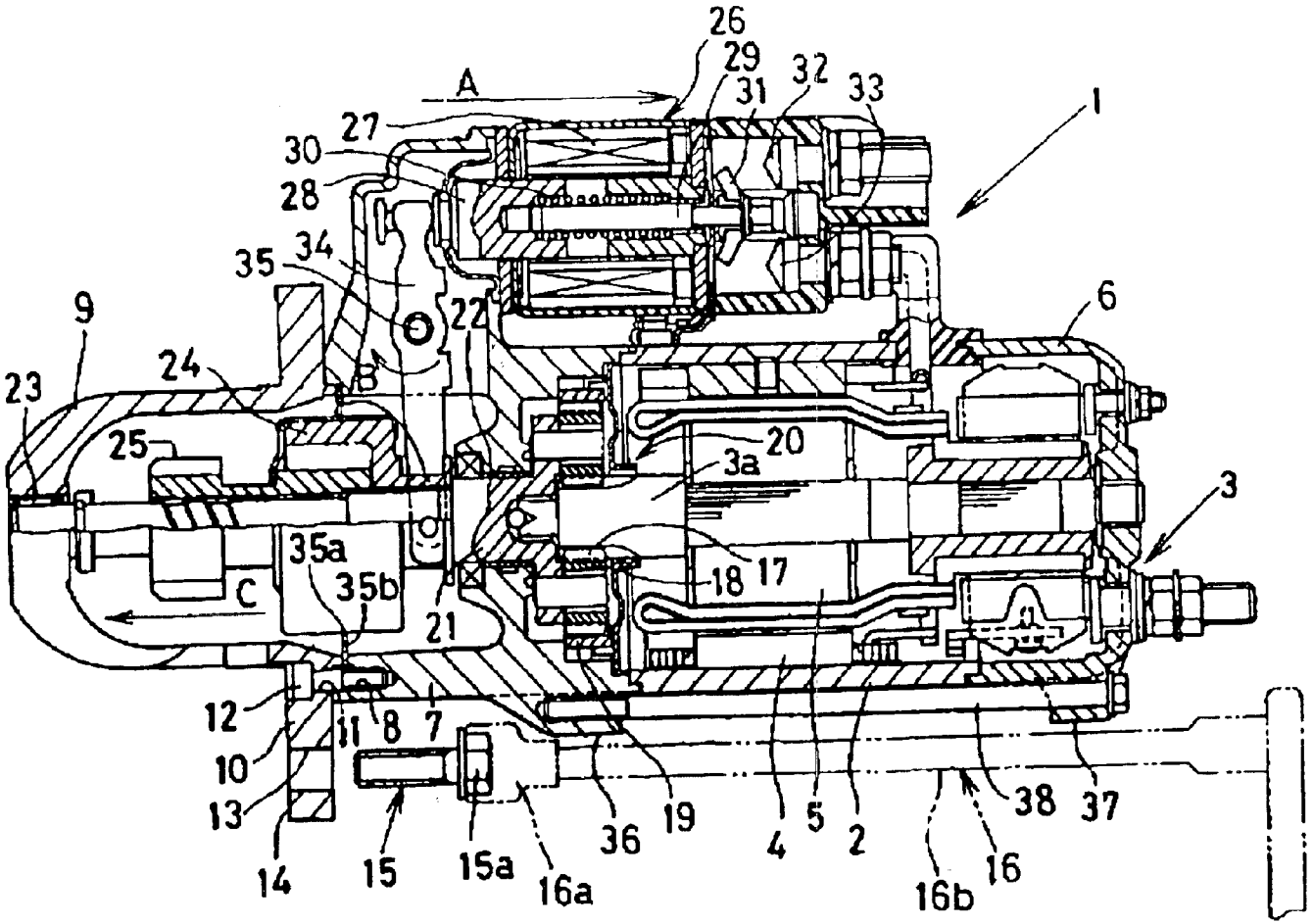
FIG. 1 is a starter for an internal combustion engine according to a preferred embodiment of the invention.

A starter 1 for a large-sized diesel engine that has a capacity between 10–16 litters is shown in FIG. 1. A starter motor 3 is comprised of a motor housing 2, a stator 4, a rotor 5 disposed in the stator 4 and a motor shaft 3*a* force-fitted to the rotor 5. An end frame 6 is fixed to the rear portion of the motor housing 2, and a center casing 7 is fixed to the front portion thereof.

Figure 2:
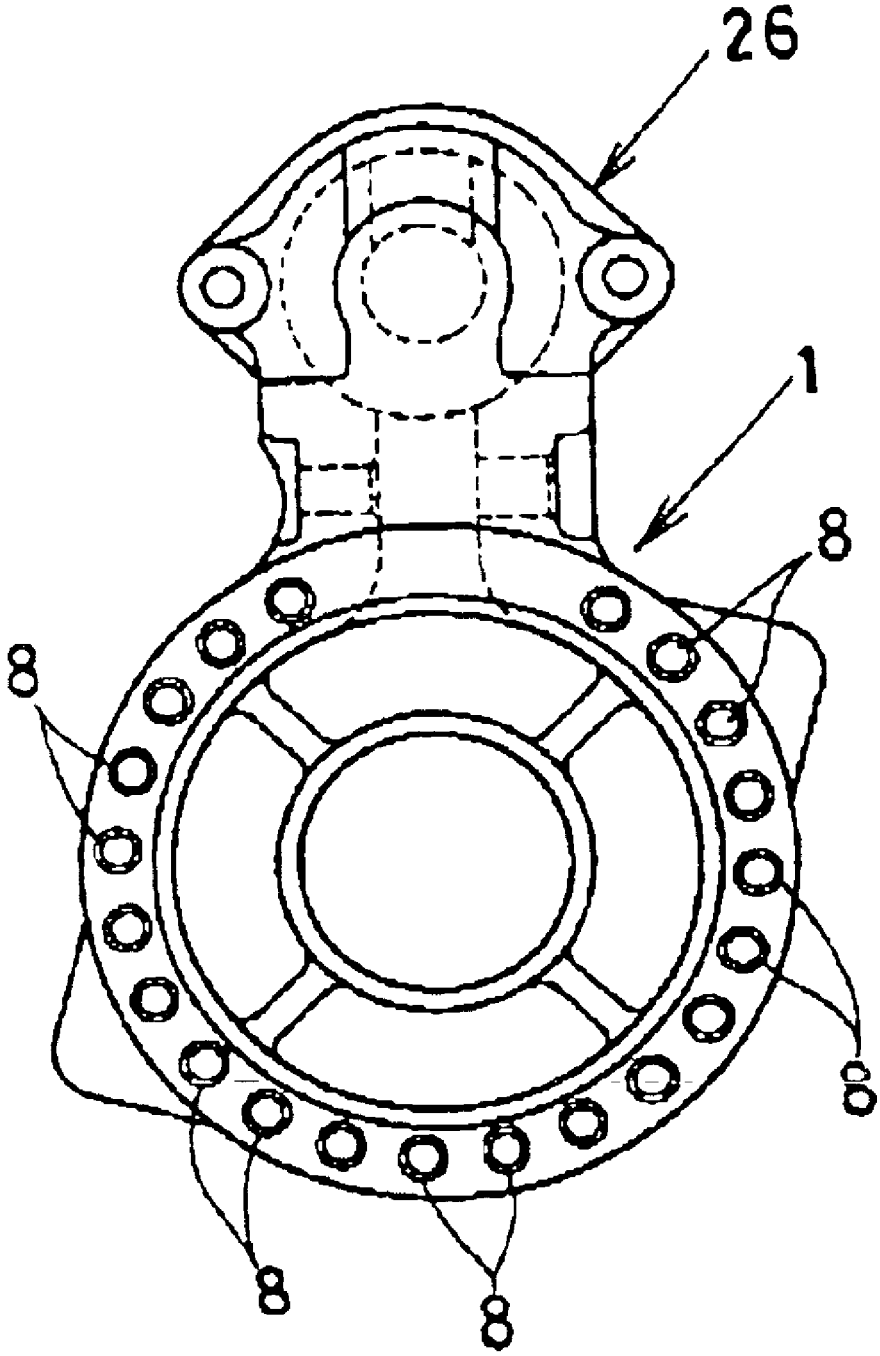
FIG. 2 is a schematic front view of a center housing connected to a motor housing of the starter according to the preferred embodiment.
Figure 3:
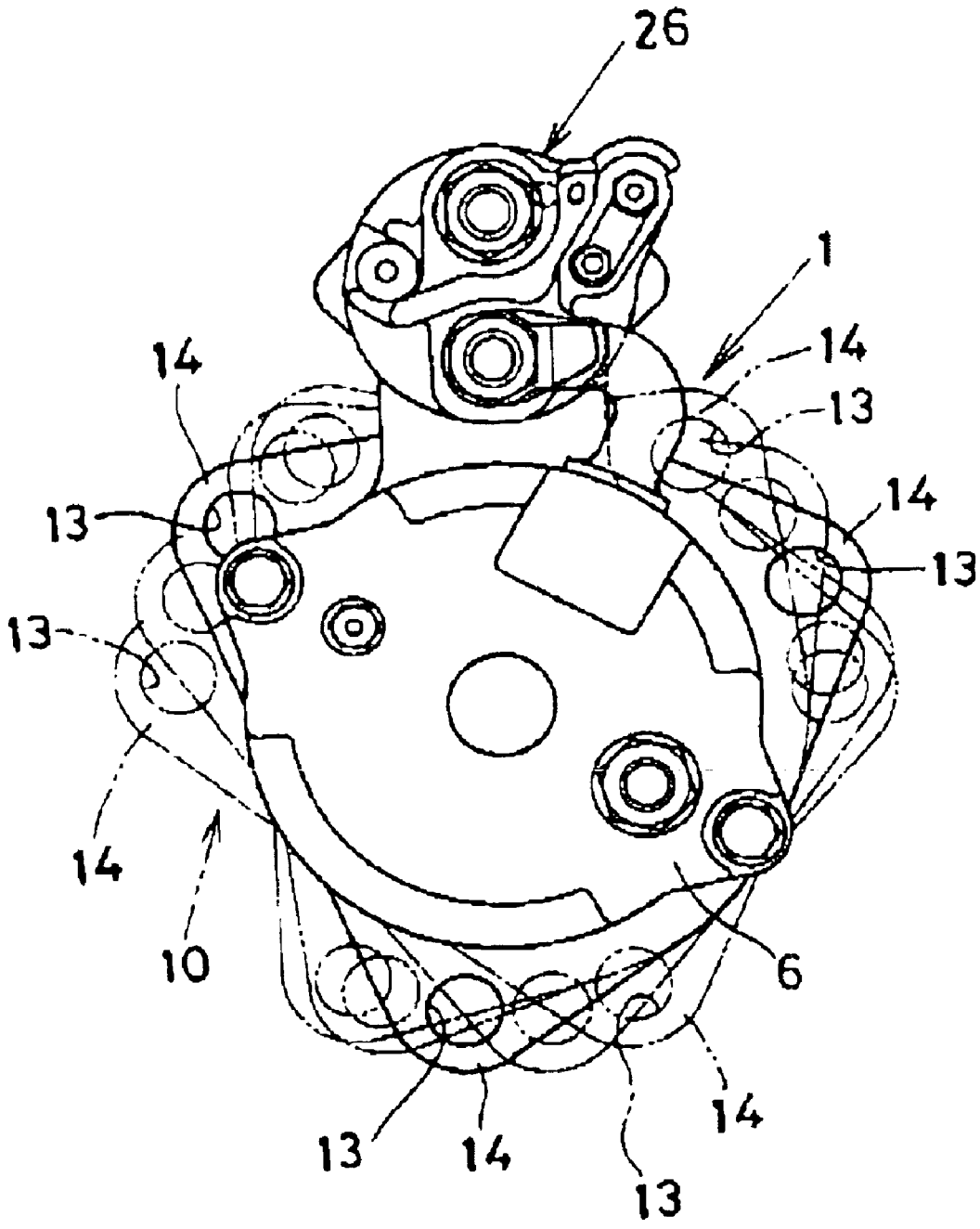
FIG. 3 is a schematic diagram illustrating variations of assembling the starter according to the preferred embodiment.

A plurality (e.g. twenty one) of female screws 8 is formed at the front surface of the center casing 7 at equal intervals except for an upper portion thereof, as shown in FIG. 2. A cup-shaped front housing 9 has a flange 10 at the open end thereof, where a plurality (e.g. six) of through holes 11 is formed at portions corresponding to the female screws 8. The flange 10 also has three ear-like fixing portions 14 projecting radially outward from the outer periphery thereof at equal intervals. Each of the fixing portions 14 has a fastening hole 13. The front housing 9 is fixed to the front surface of the center casing 7 at the flange 10 by a plurality (e.g. six) of bolts 12 that is screwed into a portion (e.g. six) of the plurality (e.g. twenty one) of the female screws 8 via the through holes 11. As shown in FIG. 3, the front housing 9 can be fixed to the center casing 7 at a most appropriate angular position of the center casing 7 so that the starter 1 can be on a different engine.

Figure 4:
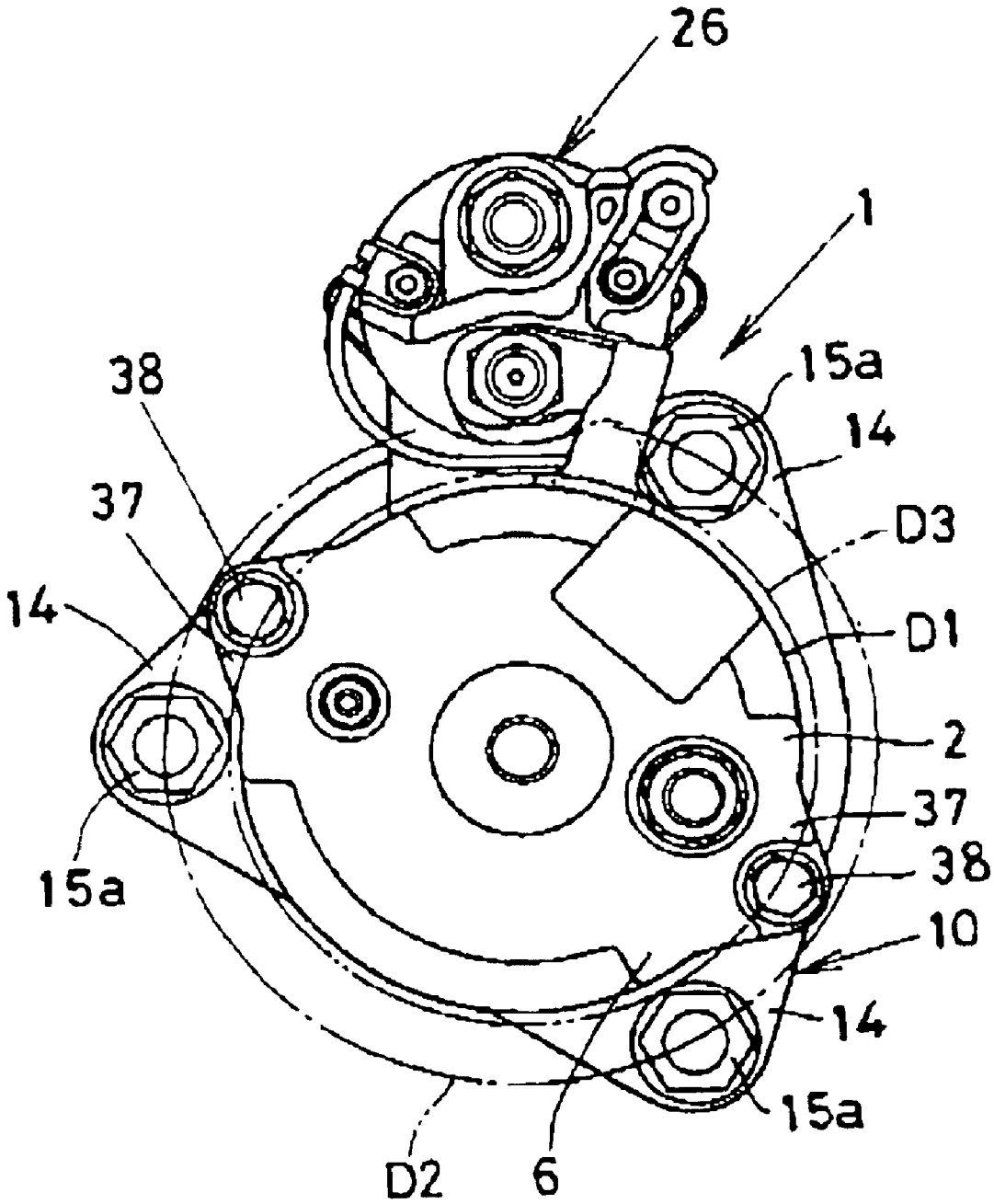
FIG. 4 is a rear view of the starter according to the preferred embodiment.

The motor housing 2, the end frame 6 and the center casing 7 have nearly the same outside diameter D1. The starter 1 is fixed to a bracket (not shown) of the engine by three fastening bolt 15 at the fastening holes 13. The fastening holes 13 are formed on a circumference of a diameter D2 to prevent the motor housing 2 from obstructing the heads 15*a* of the fastening bolts 15 being inserted into the fastening holes 13, as shown in FIG. 4. In other words, the outside diameter D1 is made smaller than an inscribed circle D3 of the head of the fastening bolts 15. That is, the outside diameter D1 is a maximum outside diameter of the fastening bolt less than the diameter D2 of the circumference on which the fastening holes are formed. Accordingly, a fixing tool, such as a socket wrench 16, can have access to the heads 15*a* of the fastening bolts 15 around the motor housing 2.

The end frame 6 and the center casing 7 respectively have two pairs of radially projecting fixing portions 36 and 37 and are fastened to each other by two fastening bolts 38 at the fixing portions 36 and 37. They are located away from the three fixing portions 14 of the front housing 9 so as not to obstruct the socket wrench 16, as shown in FIG. 4.

The motor shaft 3*a* extends to the inside of the center housing 7 and carries a sun gear 17 of a planetary gear speed reduction mechanism 20 that is comprised of planetary gears 18 and an internal gear 19. The planetary gears 18 are fixed to the rear portion of a drive shaft 21, and the internal gear 19 is fixed to the inner wall of the center casing 7.

The drive shaft 21 is supported at the rear end thereof by the center housing 7 via a rear bearing 22 and at the front end by the front housing 9 via a front bearing 23 so that the drive shaft 21 can be coaxial with the motor shaft 3*a*. An over running clutch 24 and a pinion 25 are carried by the drive shaft 21 so that they can reciprocate along the drive shaft 21.

An electromagnetic plunger 26 is disposed on the motor housing 2 and the center housing 7. The electromagnetic plunger 26 is comprised of an electromagnetic coil 27, a plunger 28, a rod 29, a compression coil spring 30, a contact bridge 31 and a pair of stationary contacts 32 and 33. The coil spring and the rod 29 are disposed inside the electromagnetic coil 27. The contact bridge 31 is fixed to the end of the plunger 28 that projects from the electromagnetic coil 27 to face the pair of stationary contacts 32 and 33.

A lever 34 is rotatably supported by a pin 35. The lever 34 is fixed at the upper end thereof to a front portion of the plunger 28.

A ring-shaped dust seal 35*b* is disposed between the flange 10 and the center casing 7 so that the inner edge 35*a* of the dust seal 35*b* contact the outer periphery of the overrunning clutch 24, thereby keeping dust off the inside of the center housing 7.

When a key switch is turned on, the electromagnet switch 27 is energized to move the plunger 28, together with the rod 29, in a direction indicated by an arrow A. Consequently, the lever 34 rotates about the pin 35 in a direction indicated by an arrow B. Therefore, the pinion 25, together with the overrunning clutch 24, is moved along the drive shaft 21 in a direction indicated by an arrow C to engage a ring gear (not shown) of the engine.

When the plunger 28 moves in the direction indicated by the arrow A, the rod 29 urges the contact bridge 31 against the stationary contacts 32 and 33 and closes the power circuit of the motor 3. Accordingly, the motor shaft 3*a* rotates the drive shaft 21 via the sun gear 17 and the planetary gears 18 of the planetary gear speed reduction mechanism 20. Thus, the ring gear is rotated, and the engine is started.

If the diameter of the circumference for the fastening holes is 146 mm and if the outside diameter of a socket wrench is 28 mm, the outside diameter D1 of the motor housing should be 118 mm or less.

It is generally known that the heat capacity of the motor is proportional to $D1^2 \times L$, where L is an axial length of the motor. If the length is not increased, motor current should be reduced in order to suppress temperature rise of the motor. Further, it is necessary to increase the output torque of the motor by increasing the speed reduction ratio of the planetary gear speed reduction mechanism 20.

Figure 5:
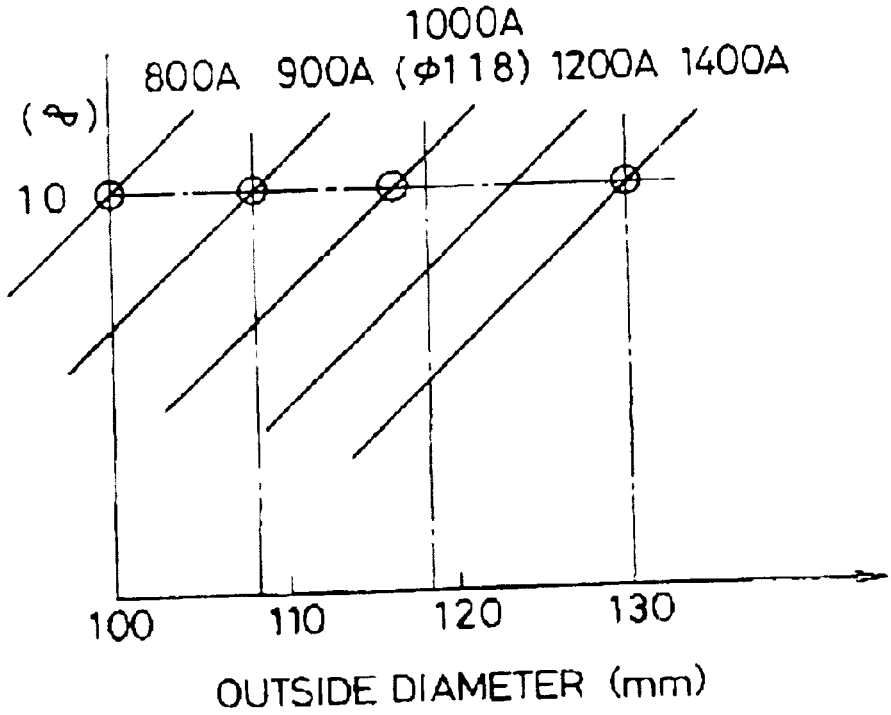
FIG. 5 is a graph showing relationship between motor current and the outside diameter of a starter motor.
Figure 6:
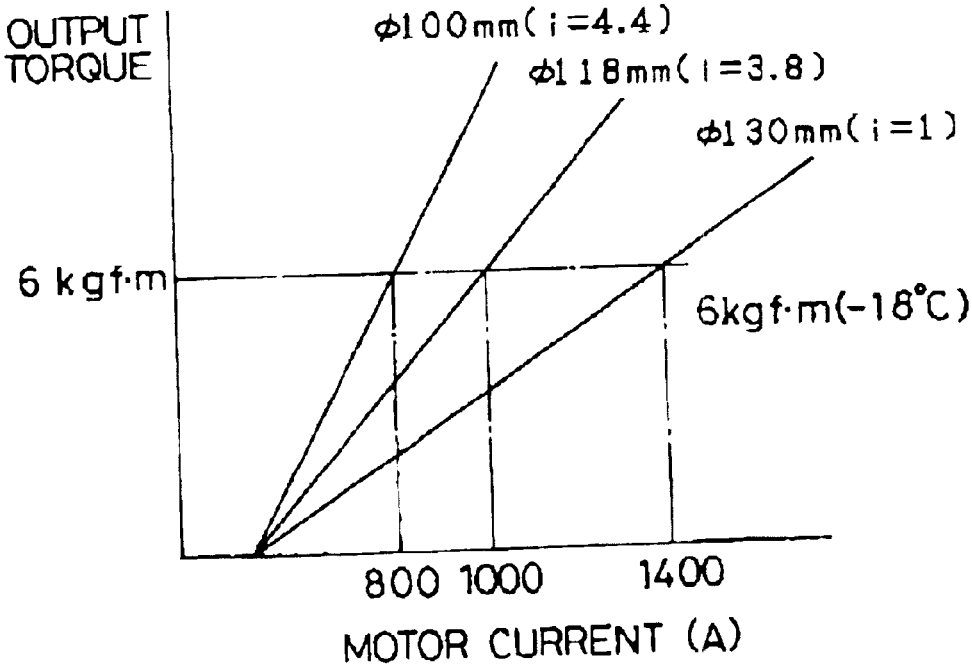
FIG. 6 is a graph showing relationship between the motor current and the speed reduction ratio of a planetary gear speed reduction mechanism.

If the output torque of a sample starter motor whose outside diameter is 130 mm is 6 kg·m/1400 A, it is possible to attain 6 kg·m/1000 A by a starter motor whose outside diameter is 118 mm, as shown in FIG. 5. Further, the speed reduction ratio has to be more than 3.8, according to a graph shown in FIG. 6.

Figure 7:
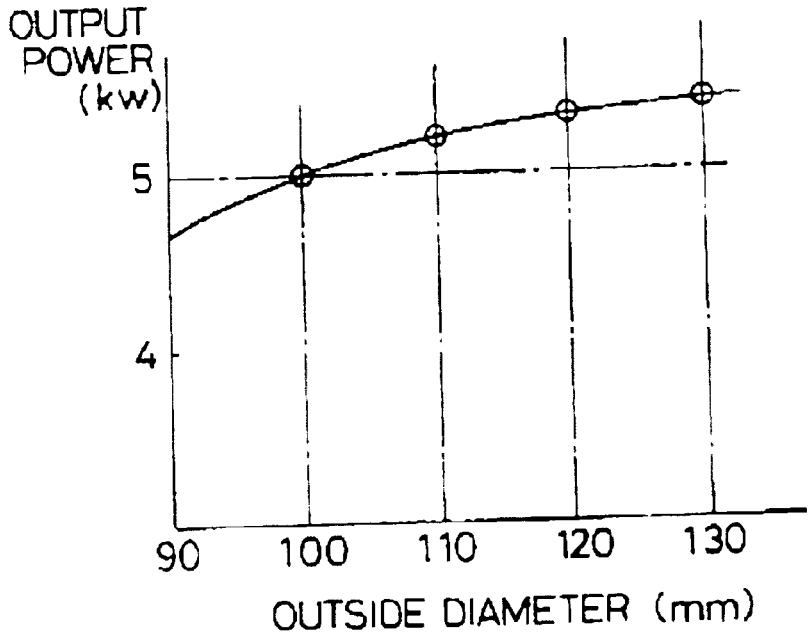
FIG. 7 is a graph showing relationship between the output power of the starter motor and the outside diameter thereof.
Figure 8:
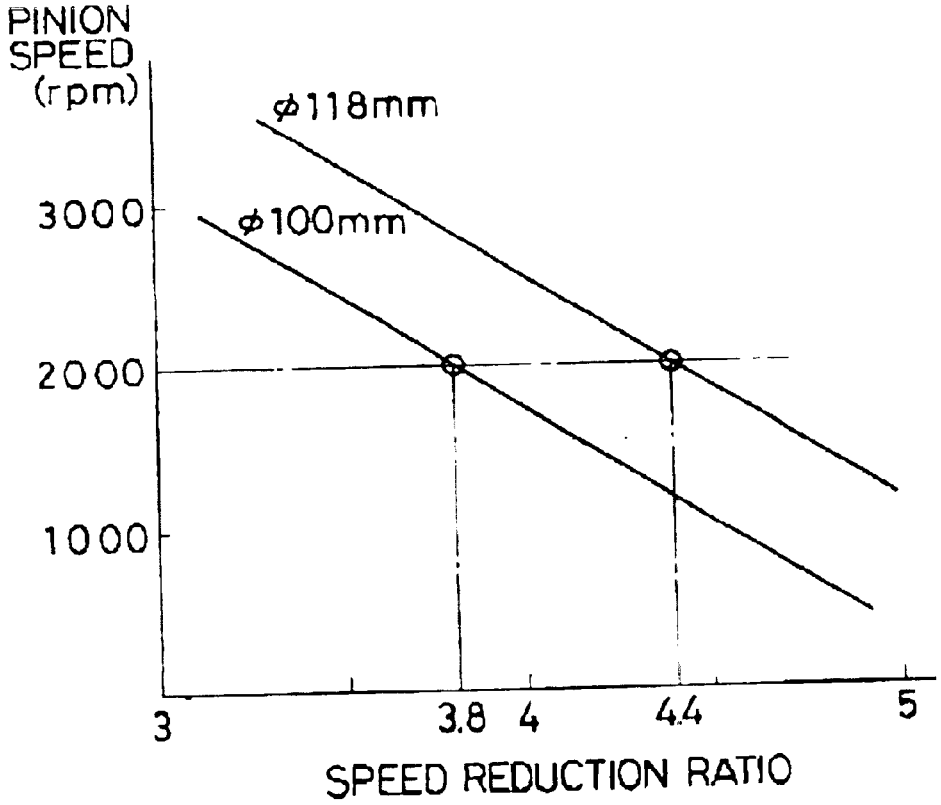
FIG. 8 is a graph sowing relationship between the rotation speed of a pinion of the starter and the outside diameter of the starter motor.

If the output power of 5 kw is necessary, the outside diameter has to be larger than 100 mm, according to a graph shown in FIG. 7. The outside diameter of larger than 100 mm can be attained if the speed reduction ratio is equal to or less than 4.4. FIG. 8 shows that the outside diameter between 100 mm and 118 mm will rotate the pinion at 2000 rpm with the speed reduction ratio being between 3.8 and 4.4.

Thus, a compact and powerful starter that has the starter motor whose outside diameter is in the range of 100 mm–118 mm, and the planetary gear speed reduction mechanism whose speed reduction ratio is in the range of 3.8–4.4.

In the foregoing description of the present invention, the invention has been disclosed with reference to specific embodiments thereof. It will, however, be evident that various modifications and changes may be made to the specific embodiments of the present invention without departing from the scope of the invention as set forth in the appended claims. Accordingly, the description of the present invention is to be regarded in an illustrative, rather than a restrictive, sense.

What is claimed is:

1. A starter for an internal combustion engine including a planetary gear speed reduction mechanism, a pinion to be engaged with a ring gear of said engine and a pinion drive shaft connected to said speed reduction mechanism, comprising:

a motor having a motor housing with a first outside diameter and a motor shaft;

a front housing for supporting said pinion drive shaft, said front housing having a bearing for supporting said pinion drive shaft at one end of said shaft and an integrally formed and radially-outwardly extending flange for providing a plurality of fastening holes disposed at a circumference having second diameter through which a plurality of fastening bolts is fixed to a portion of said internal combustion engine; and a center casing having approximately the same outside diameter as said motor housing and a bearing for supporting said pinion drive shaft at the other end, said center casing being disposed between said motor housing and said front housing for aligning said motor shaft, said planetary gear speed reduction mechanism and said pinion drive shaft; and adjusting means for fixing said front housing to a selected angular position of said center casing, wherein a difference between said first diameter and said second diameter is larger than a maximum outside diameter of said fastening bolt so that said fastening bolt can be inserted into said fastening hole along outer peripheries of said motor housing, and said adjusting means comprises a first number of female screw holes formed at an end of said center casing, a second number of through holes, which number is smaller than said first number, formed at an end of said front housing in contact with said end of said center casing and a plurality of bolts that screw into those of said female screw holes that are selected to adjust said front housing to said selected angular position.

2. The starter as claimed in claim 1, wherein said difference is larger than outside diameter of a socket wrench.

3. The starter as claimed in claim 2, further comprising an end frame having a plurality of radially projecting fixing portions disposed away from said fastening holes so as not to obstruct said socket wrench.

4. The starter as claimed in claim 1, wherein said first outside diameter of said motor housing is between 100 mm and 118 mm, and said planetary gear speed reduction mechanism has a speed reduction ratio between 3.8 and 4.4.

5. The starter as claimed in claim 1, further comprising a dust seal disposed between said front housing and said center housing.

6. The starter as claimed in claim 5, further comprising a rotary member connected to said pinion drive shaft, wherein said dust seal has an inner edge that contacts an outer periphery of said rotary member.

7. The starter as claimed in claim 6, wherein said rotary member comprises an overrunning clutch.

8. The starter as claimed in claim 1, further including a plurality of projecting members projecting radially outward, wherein said adjusting means locates each of said fastening holes away from said projecting members.

* * * * *

UNITED STATES PATENT AND TRADEMARK OFFICE

CERTIFICATE OF CORRECTION

PATENT NO. : 6,817,258 B2 
DATED : November 16, 2004
INVENTOR(S) : Sadayoshi Kajino, Youichi Hasegawa and Yasuo Osawa It is certified that error appears in the above-identified patent and that said Letters Patent is hereby corrected as shown below:

Column 6,
Line 10, insert the following:

-- 9. The starter as claimed in claim 8, wherein said adjusting means provides at least two angular positions that locate all said fastening holes away from said projecting members.

10. The starter as claimed in claim 8, wherein said fastening bolts respectively have bolt heads, and said projecting members project radially outward from an inscribed circle of said bolt heads.

11. The starter as claimed in claim 1, further comprising an electromagnetic plunger and fastening means for fixing said center housing and said motor housing together, wherein said electromagnetic plunger and said fastening means are disposed to project radially outward from the outer periphery of said motor housing and to be spaced apart from each other in the circumferential direction.

12. The starter as claimed in claim 11, wherein
said fastening bolts respectively have bolt heads, and said fastening means projects radially outward from an inscribed circle of said bolt heads.

13. The starter as claimed in claim 1, further comprising an electromagnetic plunger disposed around said motor housing and fastening means, disposed around said motor housing, for fixing said motor housing and said center housing together, wherein
said fastening means comprises a first fastening unit disposed at a first angular position away from said electromagnetic plunger in one circumferential direction and a second fastening unit disposed at a second angular position away from said electromagnetic plunger in the other circumferential direction, and wherein
said adjusting means locates one of said fastening holes between said electromagnetic plunger and said first fastening unit and another of said fastening holes between said electromagnetic plunger and said second fastening unit.

14. The starter as claimed in claim 13, wherein
said fastening bolts respectively have bolt heads, and said first and second fastening units project radially outward from an inscribed circle of said bolt heads.

15. The starter as claimed in claim 1, further comprising fastening means, disposed around said motor housing, for fixing said center housing and said motor housing together, wherein
said adjusting means is capable of locating said fastening in holes both circumferential directions from said fastening means.

16. The starter as claimed in claim 15, wherein
said fastening bolts respectively have bolt heads, and
said fastening means project radially outward from an inscribed circle of said bolt heads.

17. The starter as claimed in claim 1, wherein
the second number of said through holes is more than twice as many as the first number of said female screw holes.

18. The starter as claimed in claim 17, wherein said through holes are disposed at positions where each of said fastening holes can be located away from said projecting members. --

Signed and Sealed this

Twelfth Day of April, 2005

JON W. DUDAS
*Director of the United States Patent and Trademark Office*